US008418338B2

(12) United States Patent
Najarian et al.

(10) Patent No.: US 8,418,338 B2
(45) Date of Patent: Apr. 16, 2013

(54) PROCESS FOR RECYCLING PROTECTIVE DETAILS IN MANUFACTURING OPERATIONS

(75) Inventors: Richard T. Najarian, Birmingham, MI (US); Lisa P. Young, Bloomfield Hills, MI (US); Robert C. Gilkes, Grand Blanc, MI (US)

(73) Assignee: Precision Global Systems, Troy, MI (US)

( * ) Notice: Subject to any disclaimer, the term of this patent is extended or adjusted under 35 U.S.C. 154(b) by 163 days.

(21) Appl. No.: 13/023,896

(22) Filed: Feb. 9, 2011

(65) Prior Publication Data

US 2011/0192000 A1 Aug. 11, 2011

Related U.S. Application Data

(60) Provisional application No. 61/302,642, filed on Feb. 9, 2010.

(51) Int. Cl.
*B07B 13/00* (2006.01)

(52) U.S. Cl.
USPC ..... 29/403.1; 29/403.3; 29/407.01

(58) Field of Classification Search ..... 29/403.1, 29/403.3, 407.01
See application file for complete search history.

(56) References Cited

U.S. PATENT DOCUMENTS

| | | | | |
|---|---|---|---|---|
| 5,146,732 | A | 9/1992 | Grey et al. | |
| 5,236,603 | A | 8/1993 | Sampson | |
| 5,335,791 | A * | 8/1994 | Eason | 209/588 |
| 5,458,350 | A | 10/1995 | Johnson et al. | |
| 5,695,133 | A | 12/1997 | Morse, Jr. et al. | |
| 5,965,858 | A | 10/1999 | Suzuki et al. | |
| 6,484,390 | B1 * | 11/2002 | Gouldson et al. | 29/700 |
| 6,633,795 | B1 | 10/2003 | Suzuki et al. | |
| 7,318,265 | B2 * | 1/2008 | Takagi et al. | 29/403.1 |
| 2006/0080819 | A1 | 4/2006 | McAllister | |

FOREIGN PATENT DOCUMENTS

JP 2001215766 A * 8/2001

* cited by examiner

*Primary Examiner* — Jermie Cozart
(74) *Attorney, Agent, or Firm* — Brooks Kushman P.C.

(57) ABSTRACT

A method of recycling by reusing protective details that are removed in the course of manufacturing assembly operations is disclosed. The protective details are provided to protect subassemblies prior to final assembly operations. The protective details are collected, washed, inspected and re-certified. The re-certified parts are then reused.

9 Claims, 2 Drawing Sheets

PROCESS FOR RECYCLING PROTECTIVE DETAILS IN MANUFACTURING OPERATIONS

CROSS-REFERENCE TO RELATED APPLICATION

This application claims the benefit of U.S. provisional Application No. 61/302,642 filed Feb. 9, 2010. The disclosure of which is incorporated in its entirety by reference herein.

BACKGROUND

1. Field of the Invention

The present invention relates to recycling for reuse protective details that are used to protect sub-assemblies and other components prior to manufacturing assembly operations.

2. Background Information

Protective details are used to protect component assemblies from damage or contamination. Examples of component assemblies or parts that may be provided with protective details include electronics, glass, sensors, attached mini-assemblies associated with a component, precious metal parts, parts having precious gems, wiring harnesses, electrical connectors, seals, and fluid port openings that are used to protect sub-assemblies prior to final assembly. Protective details may be made of thermoplastics, thermoset plastics, elastomers, or the like. Protective details may be used, for example, to close and seal hydraulic ports, lubricated parts, electrical sensors, and other critical or sensitive areas on a sub-assembly during shipment and prior to final assembly.

Protective details are molded or otherwise formed to be attached to certain areas on the component assemblies or other parts. Protective details are formed to design specifications so that they fit or seal with predetermined components of a sub-assembly. For example, a vehicle transaxle may have many protective details to seal hydraulic hose fittings and receptacles. Such protective details may be attached to the transaxle after testing to seal hydraulic fluid and prevent contaminants from entering sensitive hydraulic or pneumatic fluid circuits.

When sub-assemblies with protective details are delivered to a final assembly line, the protective details are generally discarded to a solid waste landfill. While thermoplastic and elastomeric parts may be re-ground or re-melted in some manufacturing operations, the parts must be free of contaminants. It is difficult to re-grind or re-melt protective details because the surfaces of the parts may be coated with oil, grease or other foreign material. Re-grinding the protective details and then attempting to re-melt the material leads to problems due to the fact that dirt, oil or grease on a surface may contaminate and render the useless plastic re-grind material derived from the protective details.

Conventional assembly processes result in a waste stream to solid waste facilities that must be paid for by the final assembly facility. As used herein, the term "final assembly" shall be understood to refer to final or intermediate assembly operations. Further, replacing the protective details results in consumption of additional raw materials such as oil and other constituents that are used to manufacture the protective details. In addition, substantial energy is required to manufacture the protective details whether they are molded from virgin materials or recycled materials.

SUMMARY

Applicant has conceived an improved process for reducing solid waste disposal requirements for manufacturers and achieving cost savings through recycling while incurring only minimal washing, re-certification and transportation costs.

According to one aspect of the present disclosure method of recycling protective details that are used to protect sub-assemblies and other components during transportation to manufacturing and assembly operations. Parts are provided to an assembly operation in which protective details are removed. The protective details are collected and sorted if necessary. The protective details are washed to remove a contaminants and then inspected or re-certified prior to being assembled to a subsequent part.

According to another aspect of the present disclosure, a method of reusing protective details is disclosed. The details are removed from a first part and then collected. A plurality of the protective details are transported to a reuse supplier who is responsible for cleaning, inspecting and re-certifying the protective details for reuse. The protective details are then transported to a parts manufacturer and reused on a second part.

Additional aspects of the present disclosure may include the concept of disposing of any protective details that are damaged and cannot be re-certified. Damaged protective details may also be recycled by re-grinding or by using other recycling techniques.

Protective details may be transported from the assembly operation to a reconditioning and re-certifying facility before assembling the protective details onto the second part. Transporting the collected protective details after a first use may be accomplished by return shipping to the part manufacturers to reduce transportation costs. Alternatively, the protective details may be transported to a sequencing warehouse or the assembly operation instead of being shipped back to the parts manufacturer.

The protective details may be parts that are used to close and seal hydraulic ports, lubricated parts, electrical sensors and other critical or sensitive areas on a part that is to be subsequently assembled with other parts such as a vehicle engine or transmission. Protective details may be plastic caps, plugs, closure members, or plastic covers.

The above aspects of applicant's disclosure and other advantages of the method disclosed will be apparent to one of ordinary skill in the art in view of the attached drawings and the following detailed description of the illustrated embodiments.

DETAILED DESCRIPTION

Figure 1:
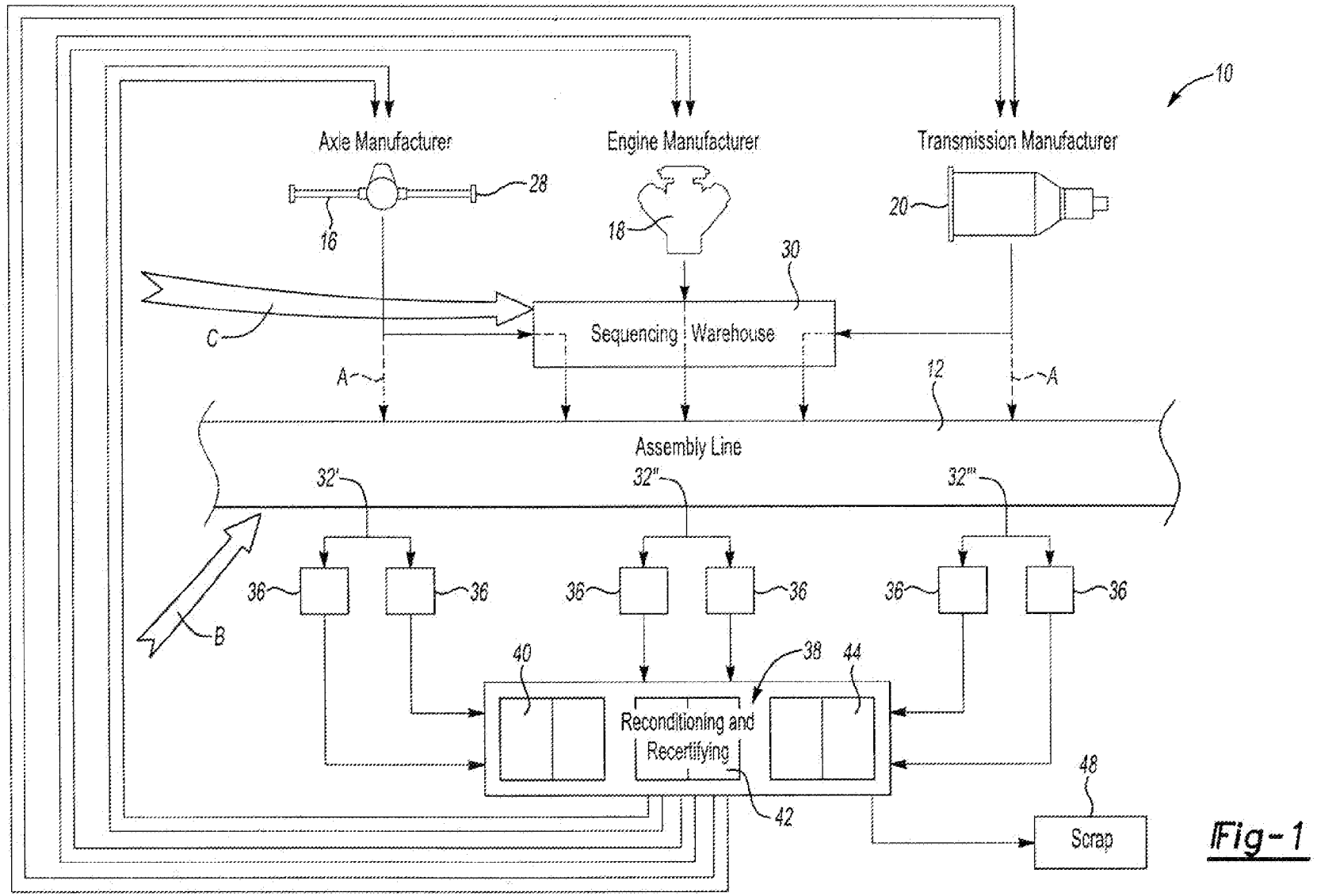
FIG. 1 is a diagrammatic process flowchart illustrating one potential embodiment of a manufacturing system that illustrates the concept disclosed in this application.

Referring to FIG. 1, a process for recycling protective details is illustrated. The process 10 is described with reference to an assembly line 12, however, the process is also amenable to other manufacturing operations or assembly procedures in which protective details are removed from sub-assemblies or components in conjunction with assembly operations.

The specific example illustrated in FIG. 1 is for an automotive assembly line 12 in which an axle 16, an engine 18 and a transmission 20 comprise examples of component assemblies that are supplied to the assembly line 12. Each of the component assemblies includes a plurality of protective details.

One example of a protective detail is identified as an end cap 28 that is provided by an axle manufacturer as part of the axle 16. As used herein, the term "protective detail" may refer to parts that may be used to close or seal hydraulic ports or lubricated parts. Protective details may also be provided to protect electrical components such as sensors or connectors or other parts that are used to hold parts together or otherwise protect critical or sensitive areas on a sub-assembly during shipment and prior to final assembly that are removed in the course of the assembly process. While FIG. 1 illustrates the invention as applied to an automotive assembly line, the invention is equally applicable to any assembly operation such as aircraft assembly, agricultural equipment, appliances, industrial goods and consumer goods where protective details are provided as part of sub-assemblies and later removed in the course of subsequent assembly operations.

The axle 16, engine 18, and transmission 20 in the illustrated embodiment are all provided to a sequencing warehouse 30 that stores the component assemblies temporarily and then provides them to the assembly line according to a production schedule. The sequencing warehouse 30 may be a separate entity or an internal operation within the facility housing the assembly line 12. The use of a sequencing warehouse 30 is not required and the sub-assembly components could be provided directly to the assembly line 12 as illustrated by dashed line extensions "A" in FIG. 1.

At the assembly line, removal stations 32', 32" and 32'" are illustrated and represent stations on the assembly line where protective details are removed from sub-assemblies. Any number of removal stations 32 can be provided and any number of protective details may be removed at the removal station 32.

When protective details are removed from the component sub-assemblies at the removal stations 32, they are deposited in identified collection receptacles that are identified to a particular protective detail. The collection receptacles 36 are preferably identified by bar code, RFID tag, printed tags or other identification mechanisms. The collection receptacles are conveniently located and may include a photograph of the protective detail to be placed in the receptacle 36. The collection receptacles 36 may be clear plastic bags or specialized containers that may be designed to facilitate collecting only the desired protective detail in the specialized container.

The protective details are transported directly or indirectly to a reconditioning and re-certifying facility 38. The collection receptacles 36 may be collected in the facility housing the assembly line 12 or may be immediately transported off site to the reconditioning and re-certifying facility 38.

In the reconditioning and re-certifying facility 38, each collection receptacle 36 is separately processed with matching protective details through a low temperature washing operation. The washing operation includes a wash section 40 in which cleaners or other detergents are used to wash oil, grease and other surface contaminants from the protective details. The protective details are then rinsed in a rinse section 42 where any residue from the wash section 40 is removed from the protective details. Finally, the protective details are dried in a drying section 44.

The protective details are then inspected by machine inspection techniques, such as machine vision, or by inspectors who visually inspect the protective details for cleanliness and to assure that only one type of protective detail is collected. If any protective details are damaged or rendered unfit for recycling, they may be designated as scrap at 48.

Each different type of protective detail is separately packaged in packages that are again identified by bar code, RFID tag, printed labels or the like and returned to the axle manufacturer if the protective details are for an axle 16, the engine manufacturer if the protective details are for the engine 18, and transmission manufacturer if the protective detail is for the transmission 20.

In an alternative embodiment of the invention, the protective details after leaving the reconditioning and re-certifying facility may be returned to either a facility housing the assembly line 12 as illustrated by arrow "B" or the sequencing warehouse 30 as illustrated by arrow "C". In either event, trucks used to transport the sub-assembly components to the sequencing warehouse 30 or assembly line 12 may return ship the containers including the reconditioned and re-certified protective components back to the axle manufacturer, engine manufacturer, or transmission manufacturer. If return shipment is possible from the assembly line 12 or sequencing warehouse 30, additional transportation costs may be saved as compared to separately shipping the recondition and re-certified protective details back to the suppliers of the sub-assembly components.

Figure 2:
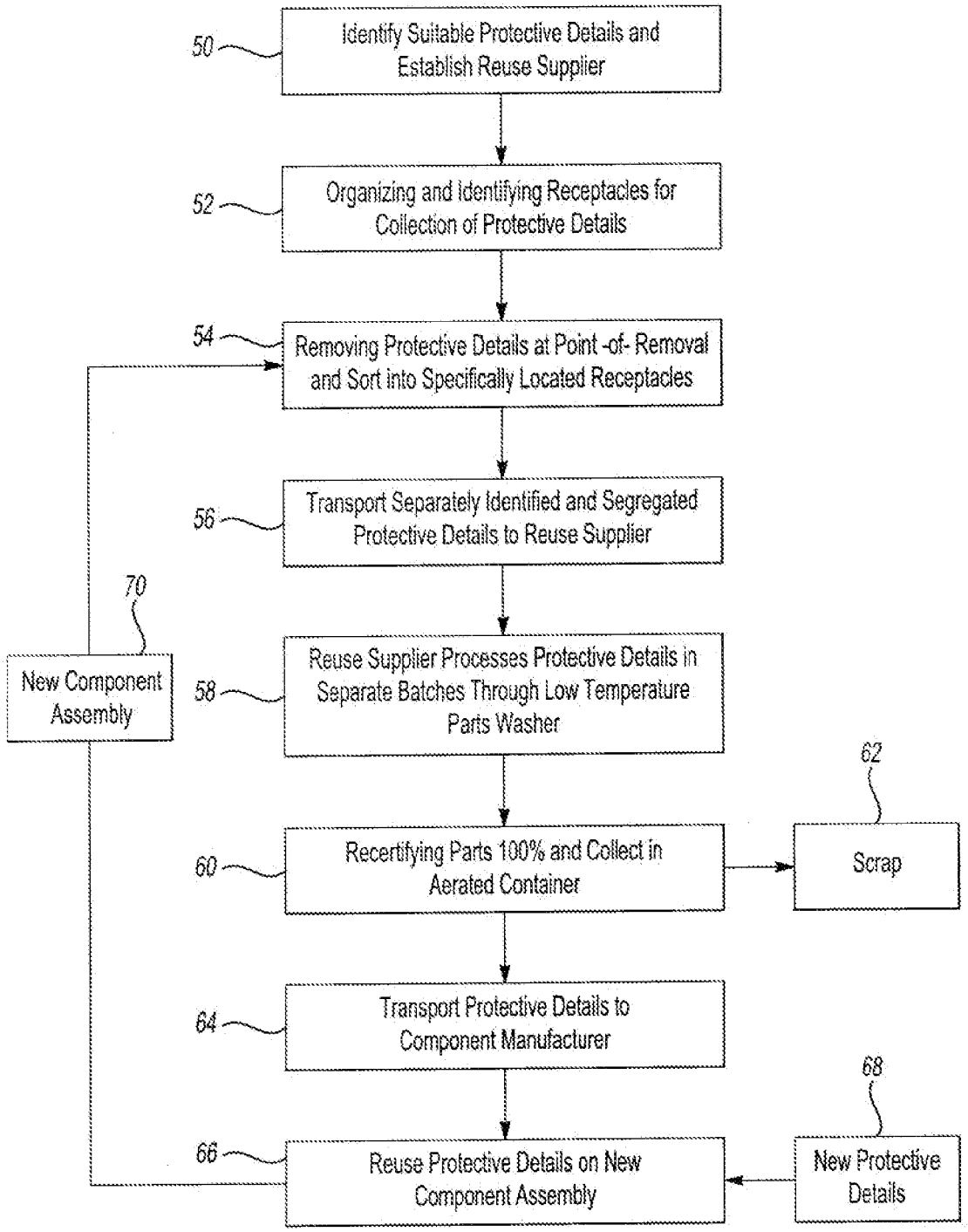
FIG. 2 is a flowchart of a protective detail recycling, refurbishing re-certifying process.

Referring to FIG. 2, a flowchart is provided to illustrate the method in a more generic form that may be adapted to a wide variety of manufacturing operations. Several protective details are identified, at 50, and a reuse supplier is established as the authorized entity responsible for managing collection of the protective details. The reuse supplier develops and provides receptacles for collection of protective details at 52. The receptacles are organized to be placed at convenient locations for collection of protective details in containers that are clearly identified.

Protective details are removed at a point of removal and sorted by assembly line personnel as they remove the protective details into the specifically located receptacles at 54.

The separately identified and segregated protective details are then transported in the receptacle to the reuse supplier at 56. The reuse supplier may be responsible for collecting the receptacles or the responsibility may be that of the assembly line personnel.

The reuse supplier processes the protective details, at 58, in separate batches through a low temperature parts washer. The low temperature parts washer preferably cleans the parts at a temperature that is below the temperature at which the protective detail would be re-melted or softened to an extent that would cause distortion or deformation of the protective details. For example, a low temperature parts washer having a water wash temperature of less than 120° F. is believed to be sufficient to protect most protective details.

Following the parts washing operation, the parts are re-certified by visual or automated inspection techniques and collected in an identified container that identifies the type of protective detail to facilitate returning the protective details to the sub-assembly component suppliers. A 100% inspection of protective details may be provided, if desired, to assure that the protective details are returned in prime condition to the proper sub-assembly component suppliers. The containers used to transport the protective details from the reuse supplier to the component manufacturer are preferably aerated containers that permit moisture to be vented from the containers after the wash operation. During the inspection process, any parts that are worn, distorted or mis-matched may be scrapped at 62.

Following reconditioning and re-certifying, the identified containers are transported, at 64, to the component manufacturer. The protective details may be temporarily warehoused for shipment to the component manufacturer or may be returned via reverse shipment to the component manufacturers utilizing transportation vehicles that are used to transport the component to the assembly line.

The protective details are then reused, at 66, on new component assemblies by the sub-assembly component manufacturers. If it is necessary to replace damaged, lost or defective details that are not fit for reuse, new protective details may be obtained from the existing supplier of new protective details, at 68.

Finally, the new component assembly including the reused protective detail is returned at 70 to the new component assembly facility. The new component assemblies are then processed on the assembly line in the normal manner beginning with removing the protective detail at the point of removal, at 54.

One example of a washer for washing the protective detail may be a two-stage rotary drum washer that heats water provided to the rinse and wash zones to a temperature less than 120° F. The rotary drum of the washer includes a rotary drum flight having kicker plates that are designed to lift small and large protective details with the drum for mechanical agitation to dislodge and separate the protective details. As shown in FIG. 1, the kicker plates are provided in the wash zone 40, rinse zone 42 and in the high pressure turbo fan dry-off zone 44. A high pressure turbo fan is used to assure adequate drying of the protective details and removal of water from cavities. A butterfly valve may be provided in the high pressure turbo fan dry-off zone to permit adjustment of the fan air flow to conserve energy.

A load hopper may be provided at the loading area of the washer that includes dividers for breaking apart the protective details that may become interconnected or tangled in the collection receptacles. The loading conveyor is also designed to transfer specific plastic parts to the washer while lifting them up to the wash zone 40. The belt of the load conveyor is preferably manufactured of rubber or plastic to prevent damage to the protective details.

At the end of the washer, an unload conveyor is provided to permit visual inspection by operators of each protective detail after the washing operation. Following inspection, the protective details are transferred to the aerated bags or other containers for shipment back to the component assembly manufacturers.

The process is intended to provide cost savings and reduce landfill requirements and costs for a wide variety of manufacturing facilities. The above process is described with reference to component suppliers or component assembly suppliers 16, 18 and 20, sequencing warehouse 30, assembly operation manufacturer 12 and the reuse supplier 38. However, depending upon the structure of the business organization or organizations, these entities may be combined as part of a single entity performing the associated functions described above. The single entity in this instance may encompass one or more component suppliers 16, 18 and 20, the sequencing warehouse 30, the assembly operation manufacturer 12, and the reuse supplier 38. Of course, any entity may be included or excluded from the combined entity depending upon operating efficiencies and organizational limitations.

By washing, re-certifying and reusing protective details, it is possible to eliminate grinding or any other post-processing of the protective details prior to disposal. The disclosed process also reduces the amount of material that must be disposed of in landfills. In this way, manufacturers may save money and reduce the use of landfills.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

We claim:

1. A method of recycling protective details comprising:
attaching at least one protective detail to each of a plurality of parts;
providing the parts with connected protective details to an assembly operation;
removing and collecting the protective details during the assembly operation;
sorting the protective details;
washing protective details to remove any contaminants on the protective details;
inspecting the protective details;
transporting the protective details to a component manufacturer; and
assembling the protective details to a second plurality of parts.

2. The method of claim 1 further comprising re-certifying the protective details after the inspecting step and before assembling the protective details to the second plurality of parts.

3. The method of claim 2 further comprising disposing of any protective details that are not re-certified.

4. The method of claim 1 further comprising transporting the protective details from the assembly operation to a reconditioning and re-certifying facility before assembling the protective details to the second plurality of parts.

5. The method of claim 1 further comprising transporting the protective details to a sequencing warehouse.

6. A method reusing protective details comprising:
removing and collecting a protective detail from each of a plurality of parts during an assembly operation;
sorting the plurality of protective details;
transporting the plurality of protective details to a reuse supplier;
cleaning the protective details;
visually inspecting the protective details;
re-certifying the protective details;
transporting the protective details to a part manufacturer; and
reusing the protective details on a second plurality of parts.

7. The method of claim 6 wherein the protective details are selected from the group including:
plastic caps;
plastic plugs;
plastic closure members; and
plastic covers.

8. The method of claim 6 further comprising disposing of any protective details that are not re-certified.

9. The method of claim 6 further comprising transporting the protective details from the assembly operation to a reconditioning and re-certifying facility before assembling the protective details to the second plurality of parts.

* * * * *